US011994139B2

(12) United States Patent
Huang et al.

(10) Patent No.: US 11,994,139 B2
(45) Date of Patent: May 28, 2024

(54) INFLATABLE PRODUCT WITH INTEGRATED AIR PUMP

(71) Applicant: Intex Marketing Ltd., Tortola (VG)

(72) Inventors: Zhi Xiong Huang, Fujian (CN); Ying Biao Zhang, Fujian (CN); Yaw Yuan Hsu, Fujian (CN)

(73) Assignee: Intex Marketing Ltd., Tortola (VG)

( * ) Notice: Subject to any disclaimer, the term of this patent is extended or adjusted under 35 U.S.C. 154(b) by 353 days.

(21) Appl. No.: 17/299,944

(22) PCT Filed: Dec. 4, 2019

(86) PCT No.: PCT/IB2019/060417
§ 371 (c)(1),
(2) Date: Jun. 4, 2021

(87) PCT Pub. No.: WO2020/115666
PCT Pub. Date: Jun. 11, 2020

(65) Prior Publication Data

US 2022/0065257 A1 Mar. 3, 2022

(30) Foreign Application Priority Data

Dec. 4, 2018 (CN) ..... 201822026536.7

(51) Int. Cl.
*F04D 25/06* (2006.01)
*A47C 27/08* (2006.01)
(Continued)

(52) U.S. Cl.
CPC ..... *F04D 25/068* (2013.01); *A47C 27/082* (2013.01); *F04D 19/002* (2013.01); *F04D 25/0673* (2013.01); *F04D 27/008* (2013.01)

(58) Field of Classification Search
CPC . A47C 27/082; F04D 19/002; F04D 25/0673; F04D 25/068; F04D 27/008
See application file for complete search history.

(56) References Cited

U.S. PATENT DOCUMENTS 4,152,094 A * 5/1979 Honda ..... F04D 19/005 415/208.5
5,586,867 A * 12/1996 Mehlos ..... F04D 29/601 416/170 R
(Continued)

FOREIGN PATENT DOCUMENTS

CN 101749262 A 6/2010
CN 203277522 U 11/2013
(Continued)

OTHER PUBLICATIONS

How to inflate an air mattress without a pump, https://www.youtube.com/watch?v=WZw3BwMBDIk—dated Jan. 2, 2016 (Year: 2016).*
(Continued)

*Primary Examiner* — Devon C Kramer
*Assistant Examiner* — Joseph S. Herrmann
(74) *Attorney, Agent, or Firm* — Faegre Drinker Biddle & Reath LLP

(57) ABSTRACT

An inflatable product includes an integrated axial-flow pump which produces a high rate of inflation. The pump includes a cover mounted to a body of the pump and selectively configurable between open and closed positions. In the open position, air is allowed to flow between the inflatable chamber and the ambient air through the pump body. When the cover is closed, the air chamber of the inflatable product is sealed with respect to the ambient air such that air is retained within the inflatable chamber when inflated. A power switch is positioned to be deactivated by the cover when the cover is mounted to the body of the pump, such that replacement of the cover during inflation or deflation of the inflatable product automatically deactivates the pump.

12 Claims, 6 Drawing Sheets

(51) Int. Cl.
*F04D 19/00* (2006.01)
*F04D 27/00* (2006.01)

(56) References Cited

U.S. PATENT DOCUMENTS 5,992,297 A * 11/1999 Plantan ..... F16J 3/02 92/98 R
6,332,760 B1 * 12/2001 Chung ..... F04D 25/0673 5/706
6,955,527 B2 * 10/2005 Yen ..... F04B 35/04 417/360
9,211,018 B2 * 12/2015 Wang ..... F04D 29/503
9,901,177 B1 * 2/2018 Ulrich ..... A47C 27/082
2006/0037145 A1 * 2/2006 Wang ..... A47C 27/084 5/709
2006/0053561 A1 * 3/2006 Metzger ..... A47C 27/082 5/713
2010/0089458 A1 * 4/2010 Chaffee ..... F16K 15/03 137/232
2013/0230410 A1 * 9/2013 Tsai ..... A47C 27/083 417/32
2017/0254337 A1 * 9/2017 Lau ..... F04D 29/422

FOREIGN PATENT DOCUMENTS

CN 206582086 U 10/2017
CN 207526720 U 6/2018
CN 209324687 U 8/2019

OTHER PUBLICATIONS

International Preliminary Report on Patentability received for PCT Patent Application No. PCT/IB2019/060417, dated Jun. 17, 2021, 7 pages.
International Search Report and Written Opinion received for PCT Patent Application No. PCT/IB2019/060417, dated Mar. 18, 2020, 9 pages.

* cited by examiner

INFLATABLE PRODUCT WITH INTEGRATED AIR PUMP

CROSS REFERENCE TO RELATED APPLICATION

This is a national stage application of International Application No. PCT/IB2019/060417, filed on Dec. 4, 2019 and entitled INFLATABLE PRODUCT WITH INTEGRATED AIR PUMP, which claims priority to Chinese Application No. CN 201822026536.7, filed Dec. 4, 2018 and entitled A NEW KIND OF INFLATABLE PRODUCT, the entire disclosures of which are hereby incorporated by reference herein.

BACKGROUND

1. Field of the Disclosure

This invention relates to inflatable products, in particular to an inflatable product having an integrated pump.

2. Description of the Related Art

Inflatable products, such as inflatable beds, inflatable rubber boats, etc., may be inflated by a built-in air transmission device. Adequate inflation is necessary to realize the full function of many inflatable products, such as weight capacity. In order to ensure adequate inflation, many such products require the nominal inflation pressures above the 180 mm WC.

Some inflatable products use a centrifugal air transmission device to inflate to these relatively high air pressures. Although such centrifugal devices can provide adequate air pressure and inflation of such high-pressure inflatable devices, they suffer from low airflow rates and an associated long inflation time, especially for larger inflatable devices such as mattresses.

What is needed is an improvement over the foregoing.

SUMMARY

The present disclosure provides an inflatable product with an integrated axial-flow pump which produces a high rate of inflation. The pump includes a cover mounted to a body of the pump and selectively configurable between open and closed positions. In the open position, air is allowed to flow between the inflatable chamber and the ambient air through the pump body. When the cover is closed, the air chamber of the inflatable product is sealed with respect to the ambient air such that air is retained within the inflatable chamber when inflated. A power switch is positioned to be deactivated by the cover when the cover is mounted to the body of the pump, such that replacement of the cover during inflation or deflation of the inflatable product automatically deactivates the pump.

In one form thereof, the present disclosure provides an inflatable product, including a product body defining a sealed interior product chamber and a pump. The pump includes a housing mounted to the product body and defining an interior housing chamber having an inner end in fluid communication with the interior product chamber and an outer end in fluid communication with ambient air around the product body; an air mover assembly having an activated configuration and a deactivated configuration; a switch having an activated position which causes the air mover assembly to activate, and a deactivated position which causes the air mover assembly to deactivate; and a cover sized and configured to mount to the outer end of the housing to seal the interior housing chamber in a closed position, and to allow air to flow through the outer end in an open position, the cover having a switch activator configured to place the switch in the deactivated position as the cover is advanced from the open position to the closed position.

In another form thereof, the present disclosure provides a pump for use in connection with inflatable products, the pump including a housing defining an interior housing chamber having an open inner end and an open outer end opposite the inner end; a motor mounted to the housing; an air mover fixed to the motor and driven by the motor when the motor is activated; a power supply mounted to the housing; a switch having electrically connected to the motor and the power supply, the switch having an activated position in which electrical current is allowed to flow from the power supply to the motor, and a deactivated position in which electrical current is prevented from flowing from the power supply to the motor; and a cover sized and configured to mount to the outer end of the housing to seal the interior housing chamber in a closed position, and to allow air to flow through the outer end in an open position, the cover having a switch activator configured to place the switch in the deactivated position as the cover is advanced from the open position to the closed position.

In yet another form thereof, the present disclosure provides a method of inflating an inflatable product, the method including opening a cover to establish a fluid communication between an interior chamber of the inflatable product and ambient air; activating a pump to direct a flow of air between the interior chamber and the ambient air; and closing the cover to seal the interior chamber of the inflatable product from the ambient air, the step of closing the cover simultaneously deactivating the pump.

BRIEF DESCRIPTION OF THE DRAWINGS

The above mentioned and other features and advantages of this disclosure, and the manner of attaining them, will become more apparent and the invention itself will be better understood by reference to the following description of embodiments of the invention taken in conjunction with the accompanying drawings, wherein.

DETAILED DESCRIPTION

Figure 1:
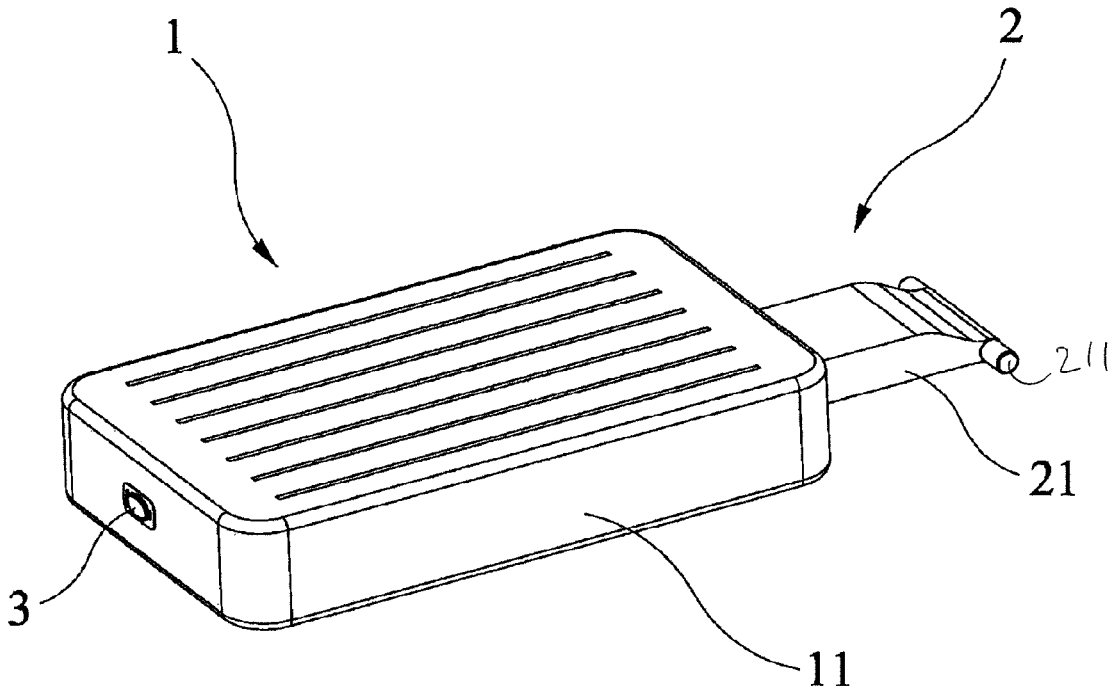
FIG. 1 is a perspective view of an inflatable product made in accordance with the present disclosure, including an air pump and a supplemental inflation chamber.

Turning now to FIG. 1, inflatable product 1 is shown as an inflatable mattress having a product body 11 defining a sealed, inflatable interior chamber as further described below. For the illustrated mattress, product body 11 includes bottom and top sheets designed to provide ground-contacting and sleeping surfaces, respectively, and a sidewall joined (e.g., by welding or other thermal fusing) to the peripheral edges of the top and bottom sheets. Inflatable product 1 may further include a set of tensioning structures contained within the inflatable chamber and fixed (e.g., by welding or other thermal fusing) to the top and bottom sheets to provide structure and maintain the mattress shape of product 1. Mattress 1 is shown and described for purposes of the present disclosure, it being understood that the principles of the present disclosure may equally be applied to other inflatable products such as inflatable pools and spas, inflatable floatation devices, and the like. One exemplary mattress which may be used in accordance with the present disclosure is described in U.S. Pat. No. 9,802,359, filed Jul. 28, 2014 and entitled METHOD FOR PRODUCING AN INFLATABLE PRODUCT, the entire disclosure of which is hereby incorporated herein by reference.

In the illustrated embodiment of FIG. 1, inflatable product includes an auxiliary air supply 2 mounted to the sidewall of the product body 11. Auxiliary air supply 2 defines an internal air supply chamber 21 nominally separate from, but in fluid communication with, the primary interior inflatable chamber of product body 11. An electric air pump 3 is mounted on the product body 11 along a portion of the sidewall between the top and bottom sheets, opposite the auxiliary air supply 2.

Figure 2:
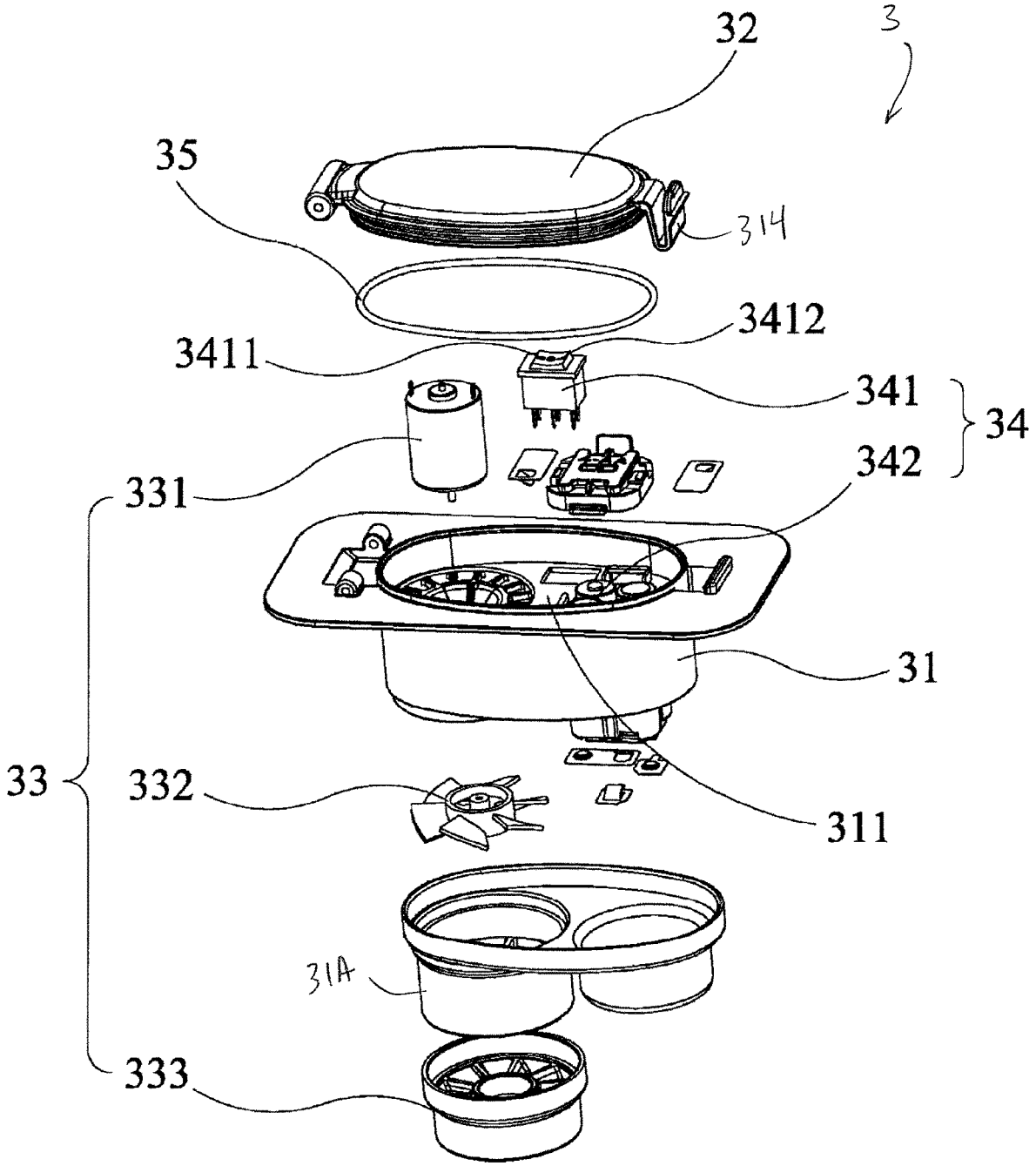
FIG. 2 is a perspective, exploded view of the air pump shown in FIG. 1.
Figure 3:
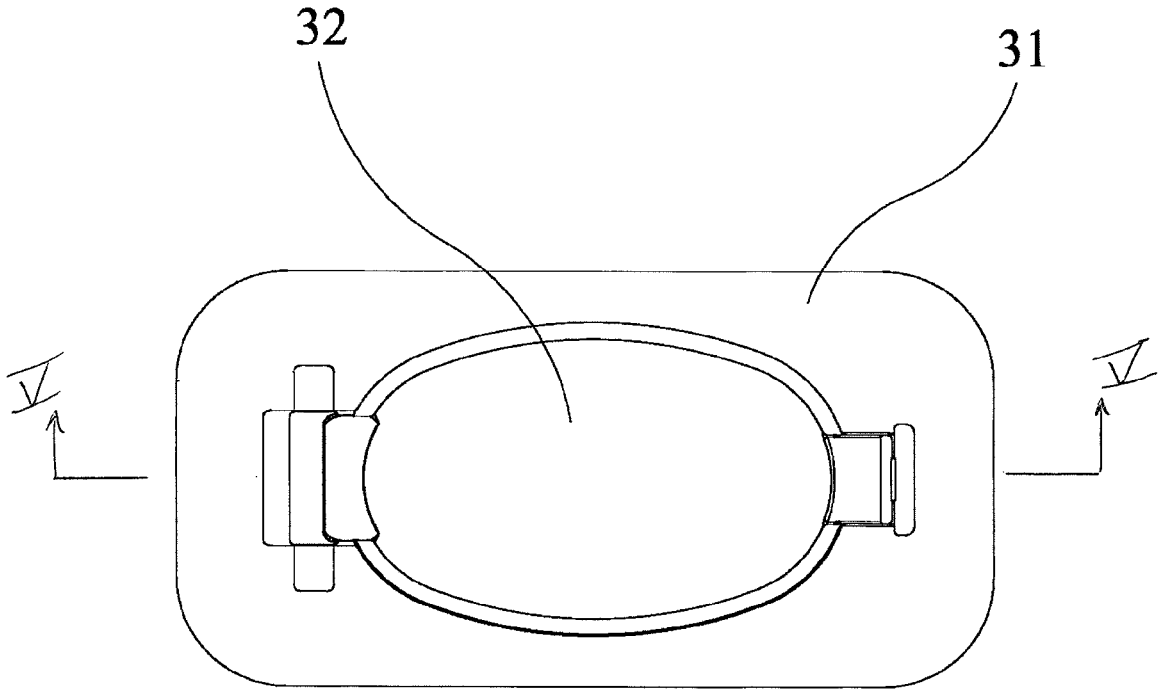
FIG. 3 is a top plan view of the air pump shown in FIG. 2, shown with the cover attached.
Figure 4:
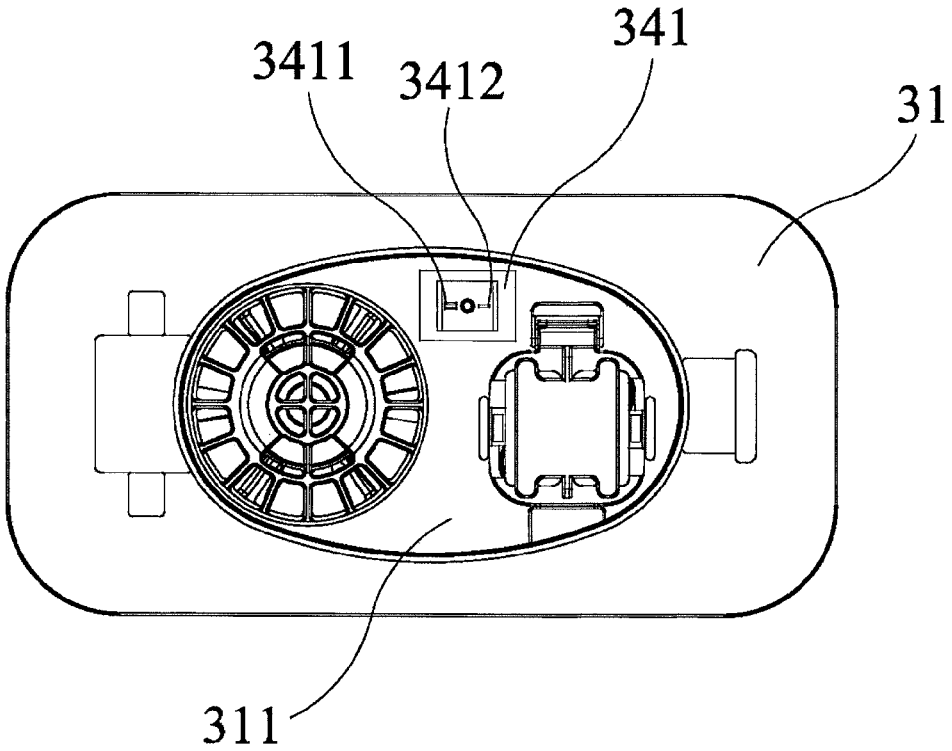
FIG. 4 is another top plan view of the air pump shown in FIG. 2, shown with the cover removed.

As best seen in FIG. 2, air pump 3 includes a pump housing 31 defining an interior chamber 311, cover 32 pivotably connected to housing 31, air mover assembly 33, and power supply 34. One end of the interior chamber 311 is in fluid communication with the inflatable chamber of the product body 11, while the opposite end is in selective fluid communication with the ambient air around inflatable product 1, depending on whether cover 32 is open or closed. The air mover assembly 33 is mounted to housing 31 within the interior chamber 311 (FIG. 5) and electrically connected to the power supply 34.

Figure 5:
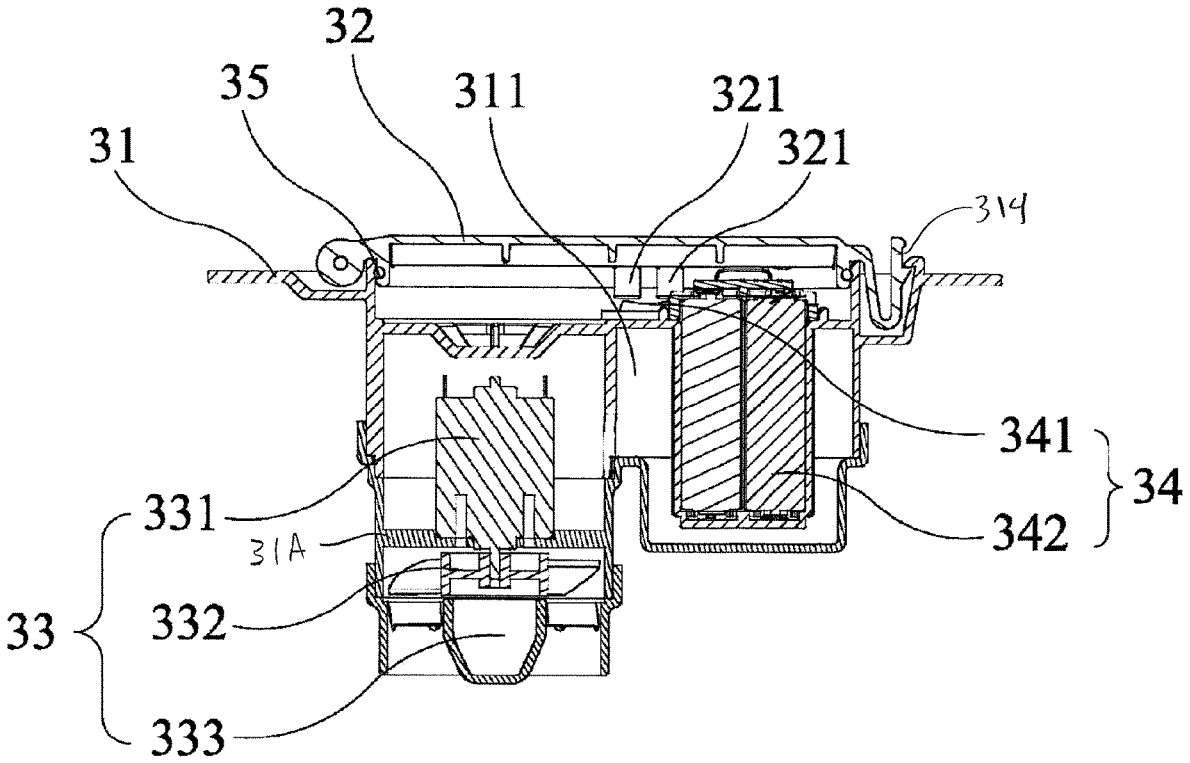
FIG. 5 is a side elevation, cross-sectional view of the air pump shown in FIG. 3, taken along the line V-V of FIG. 3.

In the illustrated embodiment of FIG. 2, pump housing 31 also includes intermediate pump housing component 31A and baffle cover 333. Pump housing 31 is mated with components 31A and cover 333 upon manufacture, as shown in FIG. 5, in order to facilitate the assembly of the various parts of air pump 3.

The air mover assembly 33 includes an electric motor 331 having an output shaft, with an axial-flow fan 332 fixed to the shaft. As best seen in FIG. 5, the motor 331 is mounted to an interior flange of pump body component 31A and electrically connected to the power supply component 34. The axial flow fan 332 is oriented interiorly of motor 331, i.e., the fan is further into the interior of product body 11. As further discussed below, the air mover assembly 33 inflates or deflates the inflatable chamber of inflatable product 1 by selectively actuating the axial flow fan 332 to blow air either inwardly or outwardly, depending on the direction of actuation. Baffle cover 333 is mounted inwardly of fan 332 and includes air distribution vanes which facilitate smooth airflow across fan 332, as further described below. Advantageously, the axial configuration of fan 332 produces a high flow volume for quick inflation of product 1. However, it is contemplated that other rotary air movers may be used in accordance with the present disclosure, such as centrifugal air movers.

Figure 6:
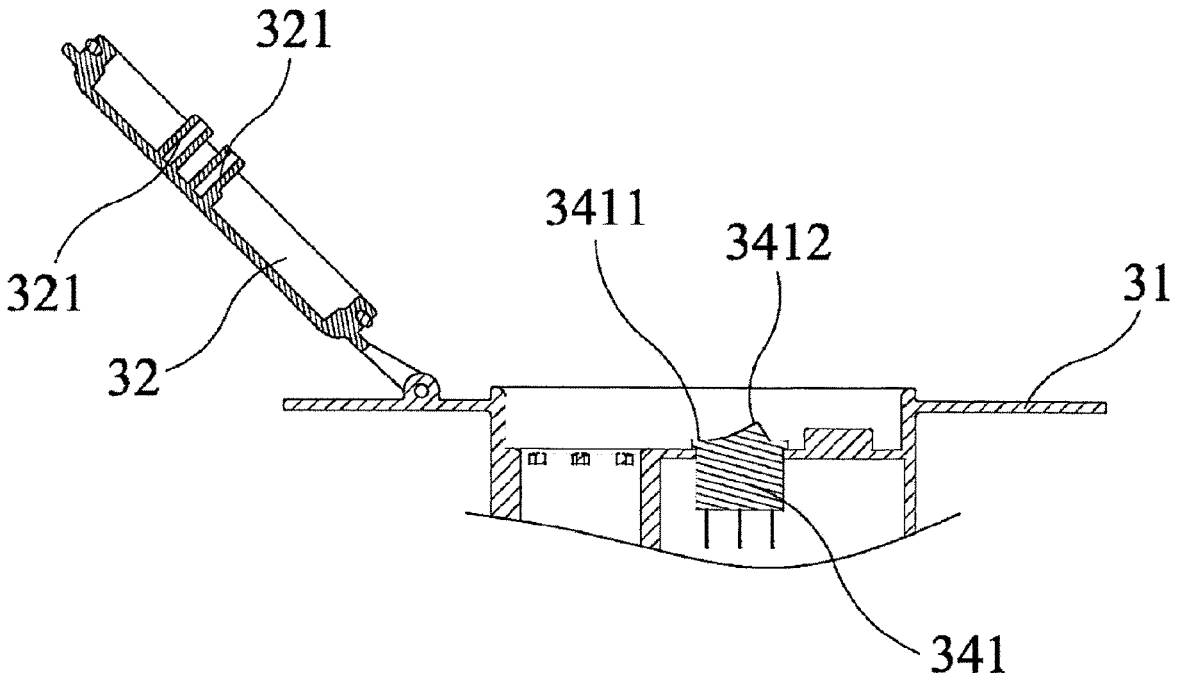
FIG. 6 is a side elevation, cross-sectional view of a portion of the air pump shown in FIG. 3, with the cover pivoted to an open configuration and the power switch in an activated state.
Figure 7:
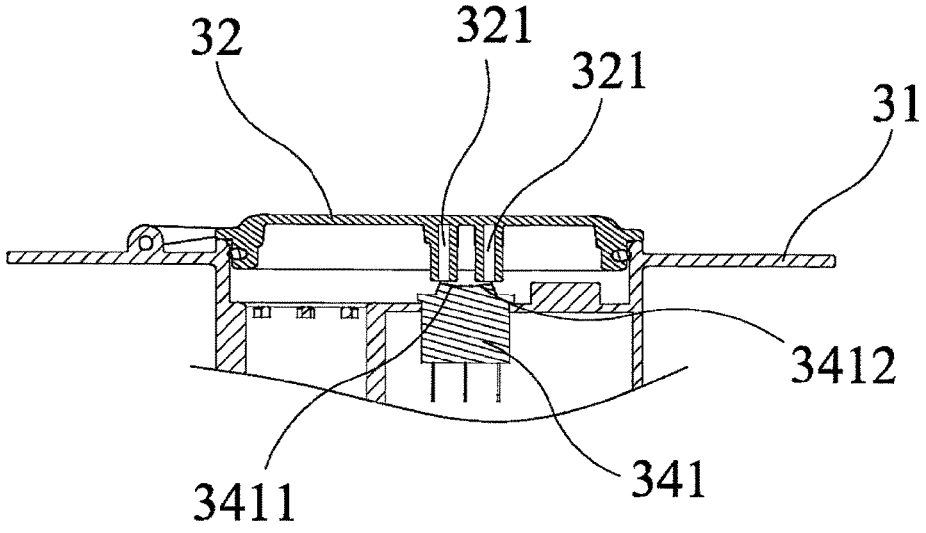
FIG. 7 is a side elevation, cross-sectional view of a portion of the air pump shown in FIG. 3, with the cover pivoted to a closed configuration and the power switch in a deactivated state.

Cover 32 can be pivoted to an open configuration (FIG. 6) or a closed configuration (FIG. 7). In the closed configuration, cover 32 hermetically seals the interior of pump housing 31 from the ambient air. In the illustrated embodiment, air pump 3 further includes a resilient O-ring 35 (FIGS. 2 and 5) mounted to an inwardly extending flange of cover 32. When cover 32 is closed (FIG. 5), O-ring 35 engages with an adjacent interior sidewall of housing 31 and sealingly couples therewith, e.g., by resiliently deforming upon engagement. O-ring 35 ensures an effective, high-pressure seal between the cover 32 and the housing 31. The provision of O-ring 35 also allows for replacement thereof, as may be expected since the cover 32 may be frequently opened or closed over the service life of inflatable product 1. This allows for a low-cost method for ensuring long-term sealing at cover 32, and allows any air leakage to be addressed with minimal effort and expense. Latch 314, shown in FIGS. 2 and 5, may be supplied to lock cover 32 in the closed position. Although the illustrated pivot and latch system is convenient, cover 32 may be removeable and replaceable by any other suitable method, such as being screwed on, latched on, attached with fasteners, etc.

The air mover assembly 33 further includes a baffle cover 333 mounted on the housing 31 and located between the axial-flow fan 332 and the interior chamber of product body 11. Product body 11 of inflatable product 1 may be made of a soft material, such as vinyl or PVC, such that product body 11 may be deformable when subject to sufficiently large forces. Baffle cover 333 effectively separates the interior surfaces of product body 11 from direct contact with the blades of axial-flow fan 332, such that activation of fan 332 from a fully deflated state will not damage the material of product body 11, and/or inhibit the proper operation of fan 332 due to an obstruction of the material of product body 11. At the same time, baffle cover 333 includes a series of radial vanes which freely allow air to flow across fan 332.

Power supply component 34 includes a double-pole double-throw (DPDT) switch 341 and battery 342, as best seen in FIGS. 2 and 5. The DPDT switch 341 is electrically connected to the battery 342 and the air mover assembly 33 respectively, and is provided with a first switch portion 3411 and a second switch portion 3412. In particular, switch 341 is operably disposed between motor 331 of air mover assembly 33 and battery 342, such that switch 341 either allows or prevents electrical current from flowing to motor 331 depending on its position, and when current flows, it either causes motor 331 to rotate in one direction or another, opposite, direction. In the illustrated embodiment, the inflation function of the air mover assembly 33 can be activated by closing the first switch portion 3411 to close a first electrical terminal, while the exhaust function of the air mover assembly 33 can be activated by closing the second switch portion 3412 to close a second electrical terminal. If no air movement is desired, air mover assembly 33 can be deactivated by simultaneously opening both the electrical terminals. In the case of switch 341, which is accomplished by positioning the switch rocker in a neutral position in which neither the first switch portion 3411 nor the second switch portion 3412 is depressed.

Turning to FIGS. 6 and 7, sealing cover 32 includes a pair of legs 321 at its interior-facing surface. The legs 321 are positioned to engage the DPDT switch 341, with one leg 321 abutting the first switch portion 3411 and the other leg 321 abutting the second switch portion 3412 when cover 32 is in the closed configuration (FIG. 7). When cover 32 is open (FIG. 6), switch 341 may be manipulated by the user to inflate or deflate inflatable product 1, i.e. by rotating switch 341 to close either the first or second switch portions 3411 and 3412. After the inflation or deflation operations are completed, the user can simply close and seal cover 32 (as shown in FIG. 7).

The act of closing cover 32 simultaneously seals housing 31, as described above, and deactivates motor 331 of air mover assembly 33. In particular, the pair of legs 321 on the cover 32 respectively abut and actuate both the first switch portion 3411 and the second switch portion 3412, such that the legs 321 act as switch activators if the switch 341 is in either the "inflate" or "deflate" positions. This activation of switch 341 by cover 32 simultaneously ensures that switch 341 enters its "off" configuration regardless of the position of switch 341 prior to closing cover 32. Moreover, this simultaneous deactivation of the air mover assembly 33 and sealing of pump housing 31 prevents any escape or leakage of air after deactivation of air mover assembly 33. This, in turn prevents the internal pressure of the inflatable product 1 from falling during the process of pump deactivation and sealing of the housing 31.

In an exemplary embodiment, battery 342 is a rechargeable battery and is detachably mounted in the pump housing 31, as shown in FIG. 5. During a typical use of inflatable product 1, only one inflation operation and one deflation operation are required, so the required electric capacity is small. Therefore, the rechargeable battery 342 can be expected to meet the power demands of air mover assembly 33, while also being convenient to use and environmentally friendly.

In a method of operation of inflatable product 1, cover 32 on the pump housing 31 is first released by opening latch 314 (FIGS. 2 and 5) and pivoting cover 32 to its open configuration (FIG. 6). With cover 32 open, switch 341 is exposed and may be used to activate the power supply 34, thereby supplying power to motor 331 of air mover assembly 33, so that the air mover assembly 33 is activated. As noted above, the power supply circuit of power supply 34 can be switched for either an inflation function or a deflation function of the air mover assembly 33. When the inflation function of the air mover assembly 33 is activated, fan 332 is rotated in a first direction to blow ambient air from outside the product 1 into the sealed interior chamber of product body 11 via the interior chamber 311 of housing 31. After inflation to a desired level of internal pressure (which may be maximum internal pressure achievable through the use of air mover assembly 33), power supply 34 is deactivated and the sealing cover 32 is immediately closed to complete the inflation operation of the inflatable product 1. As noted above, the act of closing cover 32 may simultaneously deactivate power supply 34 by deactivating both switch portions 3411 and 3412 (FIG. 7) such that neither switch terminal is closed.

Conversely, if the inflatable product 1 is inflated and a user desired to use air mover assembly 33 for powered deflation the deflation function of the air mover assembly 33 is activated as described above. When the deflation function of the air mover assembly 33 is activated, fan 332 is rotated in a second direction opposite the first direction associated with inflation, thereby blowing air within the sealed interior chamber of product body 11 outside to the ambient air via the interior chamber 311 of housing 31. After the deflation is complete, power supply 34 is deactivated and the sealing cover 32 is immediately closed to complete the deflation operation of the inflatable product 1. As noted above, the act of closing cover 32 may simultaneously deactivate power supply 34 by opening both switch portions 3411 and 3412 (FIG. 7) such that neither switch terminal is closed.

As noted above and shown in FIG. 1, an auxiliary air supply 2 may be mounted to an exterior sidewall of the product body 11. Auxiliary air supply 2 has an internal chamber 21 in fluid communication with the interior chamber of product body 11. During use of inflatable product 1, the interior chamber of product body 11 may be initially inflated by air mover assembly 3 as described in detail above. This inflation process may also inflate chamber 21 of auxiliary air supply 2, such that auxiliary air supply 2 extends outwardly away from the sidewall of inflatable body 11 as shown in FIG. 1. After air mover assembly 3 is closed and deactivated as described above, auxiliary air supply 2 may be used to provide additional internal pressure (and, therefore, mattress firmness) by discharging the air from internal chamber 21 into the product body 11. For example, roller 211 may be rolled up to compress internal chamber 21 and discharge its air into the main chamber of product body 11.

Auxiliary air supply 2 may also be replaced or supplemented with a high-pressure air pump capable of producing higher internal pressures within the interior of product body 11, as compared to the pressures attainable with air pump 3. Such a high-pressure pump may be integrated into product body 11 in a similar fashion to pump 3, or may be externally operated to drive air into product body 11 via a port or valve.

Figure 8:
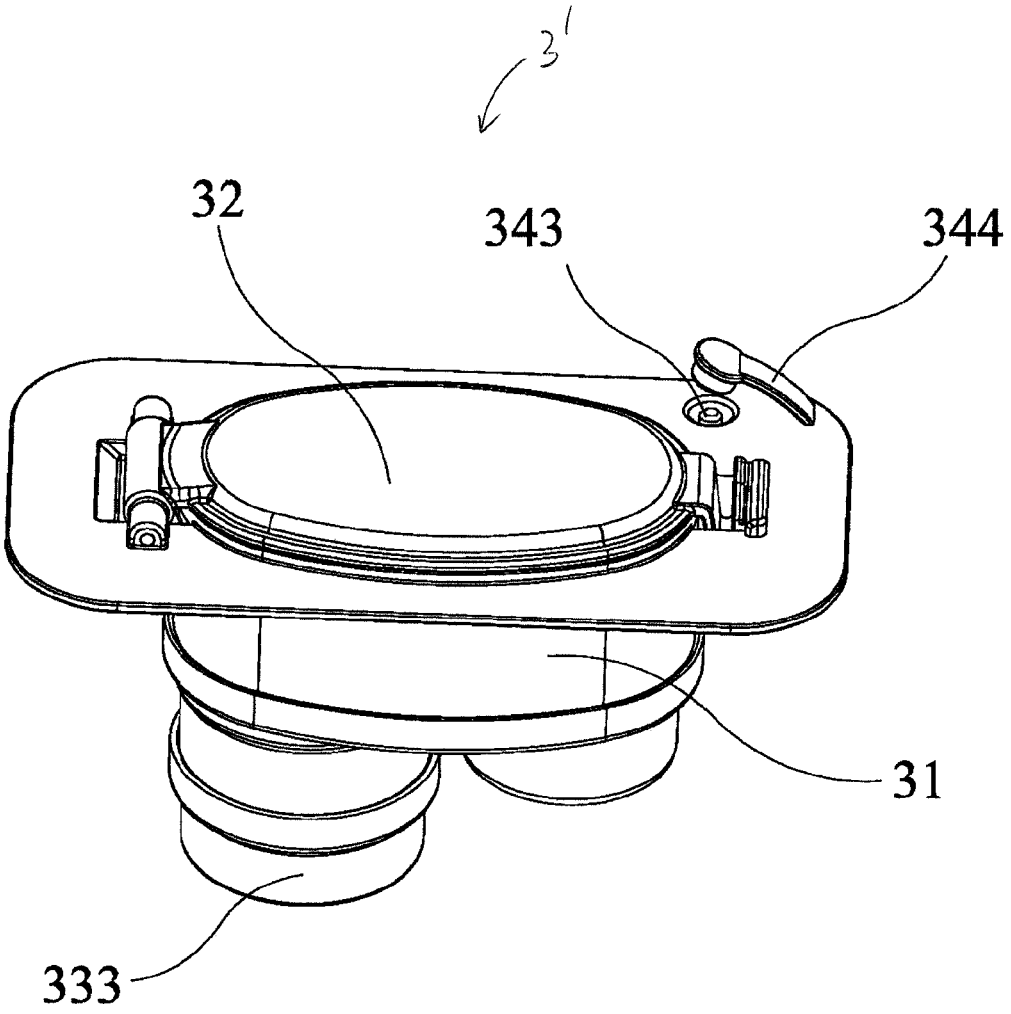
FIG. 8 is a perspective view of another air pump in accordance with the present disclosure.

Turning now to FIG. 8, an alternative air pump 3' is shown. Air pump 3' is similar to the air pump 3 shown and described above, but includes a modification to power supply 34. In this arrangement, power supply 34 is provided with a power interface 343, and may exclude battery 342 (FIG. 5). The DPDT switch 341 is electrically interposed between to the power interface 343 and the air mover assembly 33. This allows motor 331 to be powered by an external flow of electrical current brought by a cable connected to interface 343, rather than drawing current from battery 342 as described above. This arrangement may be suitable, for example, in inflatable products that are used in a stationary manner and/or inflatable products which are too large to be conveniently inflated by battery 342.

The power interface 343 may be a commercial power interface 343 and/or a USB power interface 343, and is schematically illustrated. Moreover, any of various types of power interface may be used for pump 3', as required or desired for a particular inflatable product.

In the illustrated embodiment of FIG. 8, pump 3' further includes a sealing plug 344 which is movably mounted on housing 31 and configured to be selectively sealingly engaged with power interface 343. Sealing plug 344 seals and protects power interface 343 in the absence of a connection to an external power supply.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An inflatable product, comprising:

a product body defining a sealed interior product chamber; and a pump comprising:

a housing mounted to the product body and defining an interior housing chamber having an inner end in fluid communication with the interior product chamber and an outer end in fluid communication with ambient air around the product body;

an air mover assembly having a motor driving an air mover, the air mover assembly having an activated configuration and a deactivated configuration;

a switch having an activated position which causes the air mover assembly to activate, and a deactivated position which causes the air mover assembly to deactivate, the switch comprising a double pole double throw switch having a first switch portion which activates a first switch terminal to make a first electrical connection to the motor, the first electrical connection driving the air mover in a first direction, the double pole double throw switch having a second switch portion which activates a second switch terminal to make a second electrical connection to the motor, the second electrical connection driving the air mover in a second direction opposite the first direction; and a cover sized and configured to mount to the outer end of the housing to seal the interior housing chamber in a closed position, and to allow air to flow through the outer end in an open position, the cover having a switch activator configured to place the switch in the deactivated position as the cover is advanced from the open position to the closed position.

2. The inflatable product of claim 1, wherein the activated position of the switch includes a pair of activated positions respectively corresponding to an inflation and deflation of the inflatable product.

3. The inflatable product of claim 1, wherein the motor comprises: an output shaft; the air mover fixed to the output shaft and configured to move the air upon activation of the motor.

4. The inflatable product of claim 3, wherein the switch is configured to allow electrical current to flow to the motor in the activated position, and to prevent the electrical current from flowing to the motor in the deactivated position.

5. The inflatable product of claim 4, further comprising a power supply mounted to the housing, the power supply selectively electrically connected to the motor via the switch.

6. The inflatable product of claim 1, wherein the switch activator includes a first leg oriented to engage the first switch portion and a second leg oriented to engage the second switch portion when the cover is in the closed position.

7. The inflatable product of claim 6, wherein the switch selectively makes an electrical connection between the motor and a rechargeable battery mounted in the housing of the pump.

8. The inflatable product of claim 3, wherein the air mover comprises an axial-flow fan.

9. The inflatable product of claim 8, wherein the pump further comprises a baffle cover mounted on the housing and disposed between the axial-flow fan and the interior product chamber.

10. The inflatable product of claim 1, wherein the pump further comprises a resilient O-ring mounted on the cover and positioned to be disposed between the cover and the housing when the cover is in its closed position, such that the O-ring seals the interior housing chamber from the ambient air.

11. The inflatable product of claim 1, further comprising an auxiliary air supply mounted on the product body and in fluid communication with the interior product chamber, the auxiliary air supply having an internal chamber, the auxiliary air supply compressible to discharge air from the internal chamber to the interior product chamber.

12. An inflatable product, comprising:

a product body defining a sealed interior product chamber; and a pump comprising:

a housing mounted to the product body and defining an interior housing chamber having an inner end in fluid communication with the interior product chamber and an outer end in fluid communication with ambient air around the product body;

an air mover assembly having an activated configuration and a deactivated configuration;

a switch having an activated position which causes the air mover assembly to activate, and a deactivated position which causes the air mover assembly to deactivate;

a cover sized and configured to mount to the outer end of the housing to seal the interior housing chamber in a closed position, and to allow air to flow through the outer end in an open position, the cover having a switch activator configured to place the switch in the deactivated position as the cover is advanced from the open position to the closed position; and a resilient O-ring mounted on the cover and positioned to be disposed between the cover and the housing when the cover is in its closed position, such that the O-ring seals the interior housing chamber from the ambient air.

* * * * *